United States Patent [19]

Turtinen et al.

[11] Patent Number: 5,021,124

[45] Date of Patent: Jun. 4, 1991

[54] DOUBLE DOCTOR FOR A PAPER MACHINE AND METHOD FOR ADJUSTMENT OF SAME

[75] Inventors: Pekka Turtinen; Antti Kähönen, both of Jyväskylä, Finland

[73] Assignee: Valmet Paper Machinery Inc., Finland

[21] Appl. No.: 470,968

[22] Filed: Jan. 26, 1990

[30] Foreign Application Priority Data

Feb. 15, 1989 [FI] Finland ..... 890733

[51] Int. Cl.[5] ..... D21G 3/00

[52] U.S. Cl. ..... 162/199; 15/256.51; 162/272; 162/281

[58] Field of Search ..... 162/281, 272, 199, 275, 162/111; 15/256.51, 256.5; 101/425, 169; 118/652; 355/299

[56] References Cited

U.S. PATENT DOCUMENTS

| | | | |
|---|---|---|---|
| 2,203,273 | 11/1937 | Williams | 15/256.51 |
| 3,194,156 | 7/1963 | Picking | 15/256.51 |
| 4,192,231 | 3/1980 | Kawakami | 101/169 |
| 4,516,849 | 5/1985 | Tsutsui et al. | 118/652 |
| 4,821,672 | 4/1989 | Bruno | 101/169 |
| 4,919,756 | 4/1990 | Sawdai | 15/256.51 |

FOREIGN PATENT DOCUMENTS

| | | | |
|---|---|---|---|
| 694950 | 9/1964 | Canada | 162/281 |

*Primary Examiner*—Karen M. Hastings
*Attorney, Agent, or Firm*—Steinberg & Raskin

[57] ABSTRACT

The invention concerns a double doctor (10) for a paper machine, comprising the first doctor blade (12) and a second doctor blade (14), which are fitted to scrape the same roll face ($T_1$). The double doctor (10) includes a first doctor beam (11) and therein a first doctor blade (12) as well as a second doctor beam (13) and therein a second doctor blade (14). The first doctor beam (11) and the second doctor beam (13) are interconnected at their ends by means of end plates (15*a*, 15*b*), whereby an opening (C) remains between the doctor beams (11, 13) and the end plates (15*a*, 15*b*), through which opening (C) the material or paper web scraped off the roll face ($T_1$) can be passed freely into a pulper. The invention also concerns a method for adjustment of the double doctor.

6 Claims, 5 Drawing Sheets

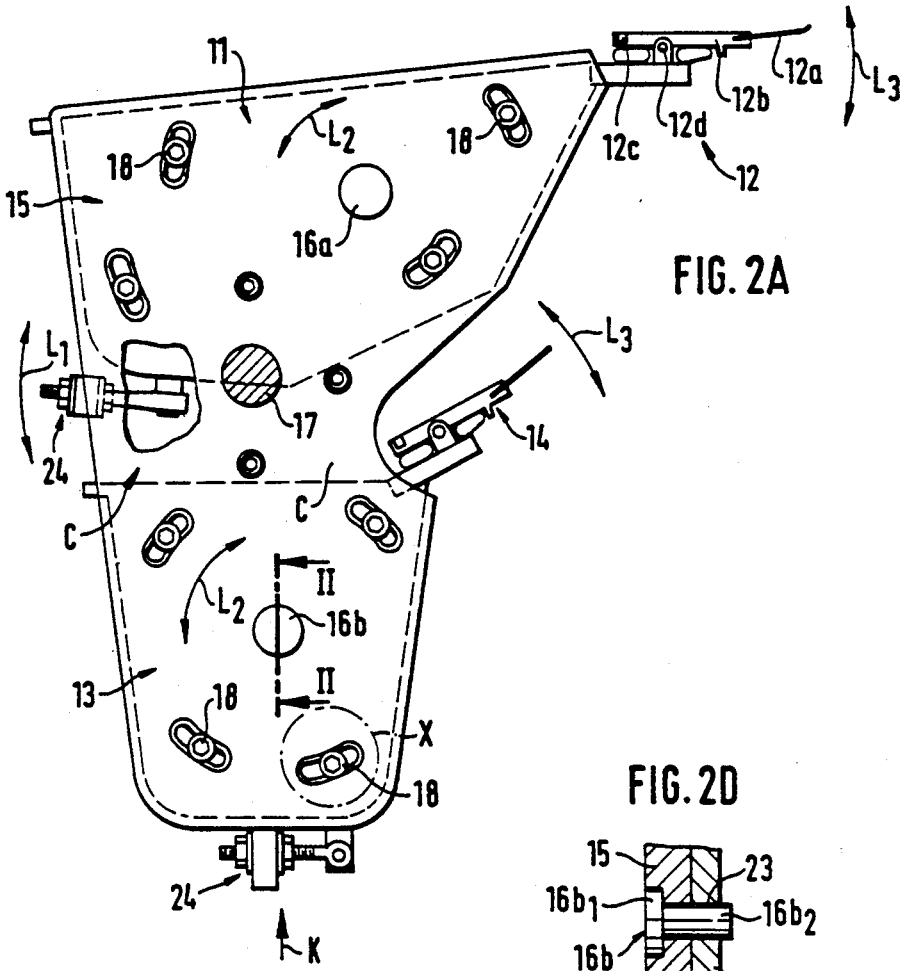
FIG. 2A
FIG. 2D
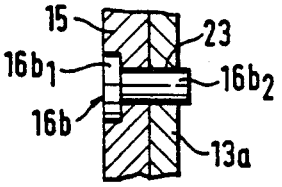
FIG. 2C
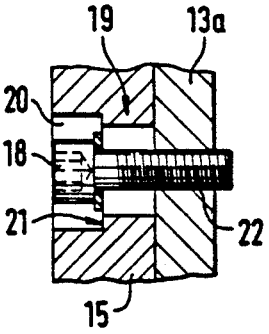
FIG. 2B
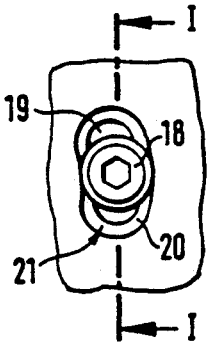
FIG. 2E
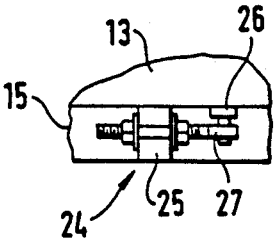

DOUBLE DOCTOR FOR A PAPER MACHINE AND METHOD FOR ADJUSTMENT OF SAME

BACKGROUND OF THE INVENTION

The invention concerns a double doctor for a paper machine and a method for adjustment of the double doctor.

In the cleaning of paper machine rolls doctors are employed, which are fitted to be pressed against the roll face and which are fitted thereby to detach any impurities that may have remained on the roll face. If the doctor construction is not sufficiently good, impurities remain on the roll face and cause contamination of the felt. This results in damage to the felt.

In the prior art, doctor constructions are also known wherein two doctor blades are placed on the same beam. The operation of the double-doctor constructions known from the prior art is, however, not satisfactory, because separate adjustment of the prior art double doctor blades is not possible. Another major drawback of the prior art double doctor constructions is difficulty in the cleaning of the space between the blades, because contaminations cannot escape from the closed frame space between the blades.

SUMMARY OF THE INVENTION

The object of the invention is a double doctor of a novel type for a paper machine. A further object of the invention is a novel method for adjustment of the doctor blades in the construction of the double doctor.

The object of the invention has been achieved by means of an embodiment wherein the double doctor construction has been formed from two separate doctor beams, which have been combined as a unified doctor construction at their ends by making use of rigid end plates. Thus, according to the invention, each doctor beam is separately adjustable in relation to the end plates. Moreover, the whole doctor construction can be rotated in relation to the axis of rotation of the construction by means of a separate actuator, e.g. a pneumatic cylinder.

The double doctor construction in accordance with the invention is mainly characterized in that the double doctor comprises a first doctor beam and therein a first doctor blade as well as a second doctor beam and therein a second doctor blade, the first doctor beam and the second doctor beam being interconnected at their ends by means of end plates, whereby an opening remains between the doctor beams and the end plates, through which opening the material or paper web scraped off the roll face can be passed freely into the pulper.

The method in accordance with the invention for adjustment of the double doctor construction of a paper machine is mainly characterized in that the doctor blades are arranged in doctor beams of their own, whereby the adjustment of the doctor blades attached to the doctor beams takes place by means of an adjusting device rotating the doctor beam in relation to the end plates attached to the doctor beams.

BRIEF DESCRIPTION OF THE DRAWINGS

The invention will be described in the following with reference to some preferred embodiments of the invention illustrated in the Figures in the accompanying drawings, the invention being, however, not supposed to be confined to said embodiments alone.

FIG. 2A is an end view of the double doctor of FIG. 1.

FIG. 2B shows an enlarged detail X of FIG. 2A.

FIG. 2C is a sectional view along line I—I in FIG. 2B.

FIG. 2D is a sectional view along line II—II in FIG. 2A.

FIG. 2E shows an actuator used in rotating a doctor beam as seen from the direction of the arrow K in FIG. 2A.

PREFERRED EMBODIMENTS OF THE INVENTION

Figure 1:
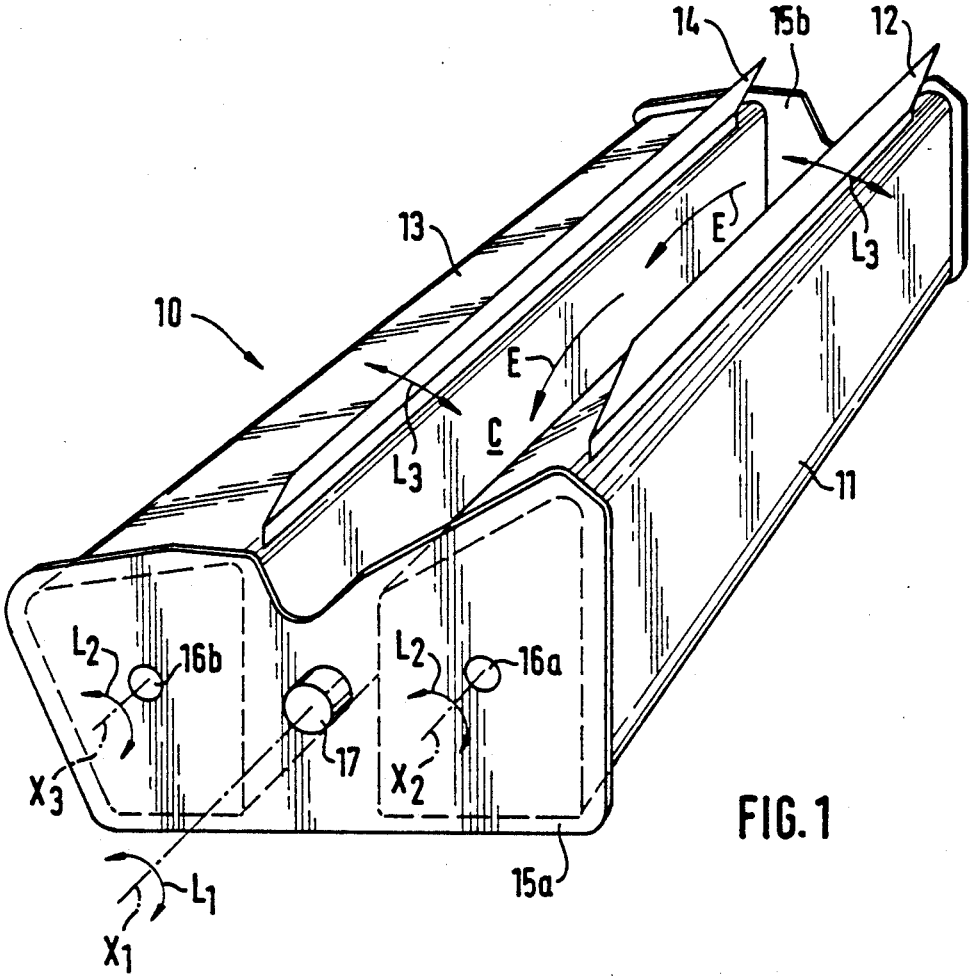
FIG. 1 is illustration of principle of a double doctor in accordance with perspective, partly sectional drawing of a preferred embodiment of the invention for use in a paper machine.

FIG. 1 is an illustration of the principle of a double doctor 10 in accordance with the invention for a paper machine. The double doctor frame in accordance with the invention for a paper machine comprises a first doctor beam 11 and therein a first doctor blade 12 as well as a second doctor beam 13 and therein a second doctor blade 14. The frame construction comprises end plates 15*a* and 15*b*, by whose means the doctor beams 11 and 12 are interconnected by their ends, whereby the construction can be rotated around the main axis of rotation $X_1$ of the double doctor construction in the way indicated by the arrow $L_1$ in FIG. 1.

Moreover, both the first doctor beam 11 and the second doctor beam 13 are fitted on the end plates 15*a* and 15*b* in such a way that they can be rotated around the longitudinal axes $X_2$ and $X_3$.

Thus, the entire double doctor construction 10 can be rotated around the shaft 17 and, moreover, the first doctor beam 11 can be rotated on the axle journal 16*a* and the second doctor beam 13 can be rotated on the axle journal 16*b*.

Moreover, the doctor blades 12 and 14 can be adjusted by means of their own adjusting devices in the directions shown by the arrows $L_3$.

The double doctor construction in accordance with the invention for a paper machine includes a free opening C between the first doctor beam 11 and the second doctor beam 13, said opening C being defined exclusively by the faces of the doctor beams 11 and 13 and by the end plates 15*a* and 15*b*. Thus, as is shown by the arrows E, the material that has been scraped off has access between the blades 12 and 14 through the opening C into the pulper (not shown).

FIG. 2A is an end view of a double doctor in accordance with the invention for a paper machine. In the Figure the fine adjustment of the double blades 12 and 14 is indicated by the arrows $L_3$. For example, the blade part 12*a* of the doctor blade 12 can be pivoted by means of the adjusting device 12c so that the frame 12b of the doctor blade 12a is pivoted on the articulated joint 12d. A corresponding adjustment can also be carried out for the other doctor blade 14. The doctor beams 11 and 13 are attached to the end plate 15 by means of the screws 18.

FIG. 2B shows an enlarged detail X in FIG. 2A. The screw 18 is passed through a curved opening 19 in the end plate 15. The opening 19 includes a recess 20 against whose bottom face 21 the screw 18 head is placed when it is tightened. The screw 18 is engaged in the threaded hole 22 provided in the end plate 13a of the doctor beam 13.

FIG. 2C is a sectional view taken along the line I—I in FIG. 2B. The Figure shows the engagement of the screw 18 in the threaded hole 22 in the end plate 13a of the doctor beam 13.

FIG. 2D is a sectional view taken along the line II—II in FIG. 2A. The journal 16b includes a shoulder part 16b$_1$, which is attached stationarily (by means of screws, not shown) to the end plate 15. The journal 16b includes a shaft part 16b$_2$, which is passed into the hole 23 in the end plate 13a. There is a sliding movement between the shaft part 16b$_2$ and the hole 23. By means of the journal 16b, the accurate rotation of the doctor beam 13 is controlled during adjustment.

FIG. 2E shows the adjusting member 24 by whose means the doctor beam 13 is rotated on the journal 16b after the screws 18 have been loosened. The adjusting member 24 includes a bracket 25, which in engagement with the end plate 15, and a pin 26, which is in engagement with the doctor beam 13. The screw 27 is passed through the bracket 25, and the end of the screw 27 is in engagement with the pin 26. When the screw 27 is rotated, the doctor beam 13 is displaced and rotated around the axis $X_3$.

The rotating of one doctor beam 13 and the adjustment of the related doctor blade 14 are described in relation to FIGS. 2B . . . 2E. The corresponding arrangement of equipment is also provided for the doctor beam 11, so that it is not described separately.

Figure 3A:
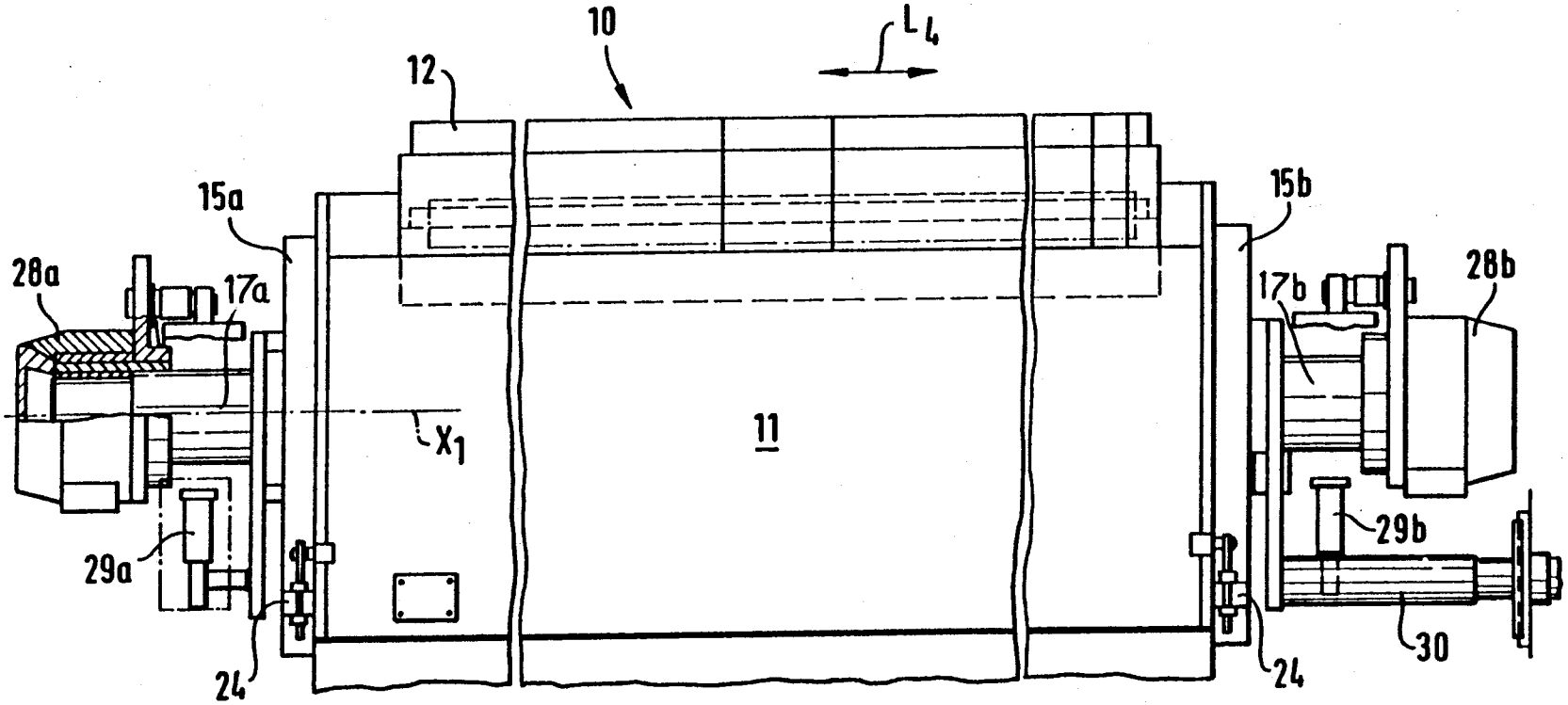
FIG. 3A shows a double doctor in accordance with the invention for a paper machine in the machine direction.

FIG. 3A shows a double doctor in accordance with the invention used in a paper machine as seen in the machine direction. The entire double doctor construction in accordance with the invention rests on the bearing members 28a and 28b when the double construction is being rotated around the axis $X_1$ of rotation of the whole construction. The shafts 17a and 17b of the end plates 15a and 15b rest on the bearings 28a and 28b. The rotating is carried out in a conventional way, e.g., by means of pneumatic cylinders 29a and 29b. By means of a conventional oscillating device 30, which is shown in the figure schematically only, the doctor blades 12 and 14 are brought into an oscillating movement in the transverse direction of the roll (arrow $L_4$).

Figure 3B:
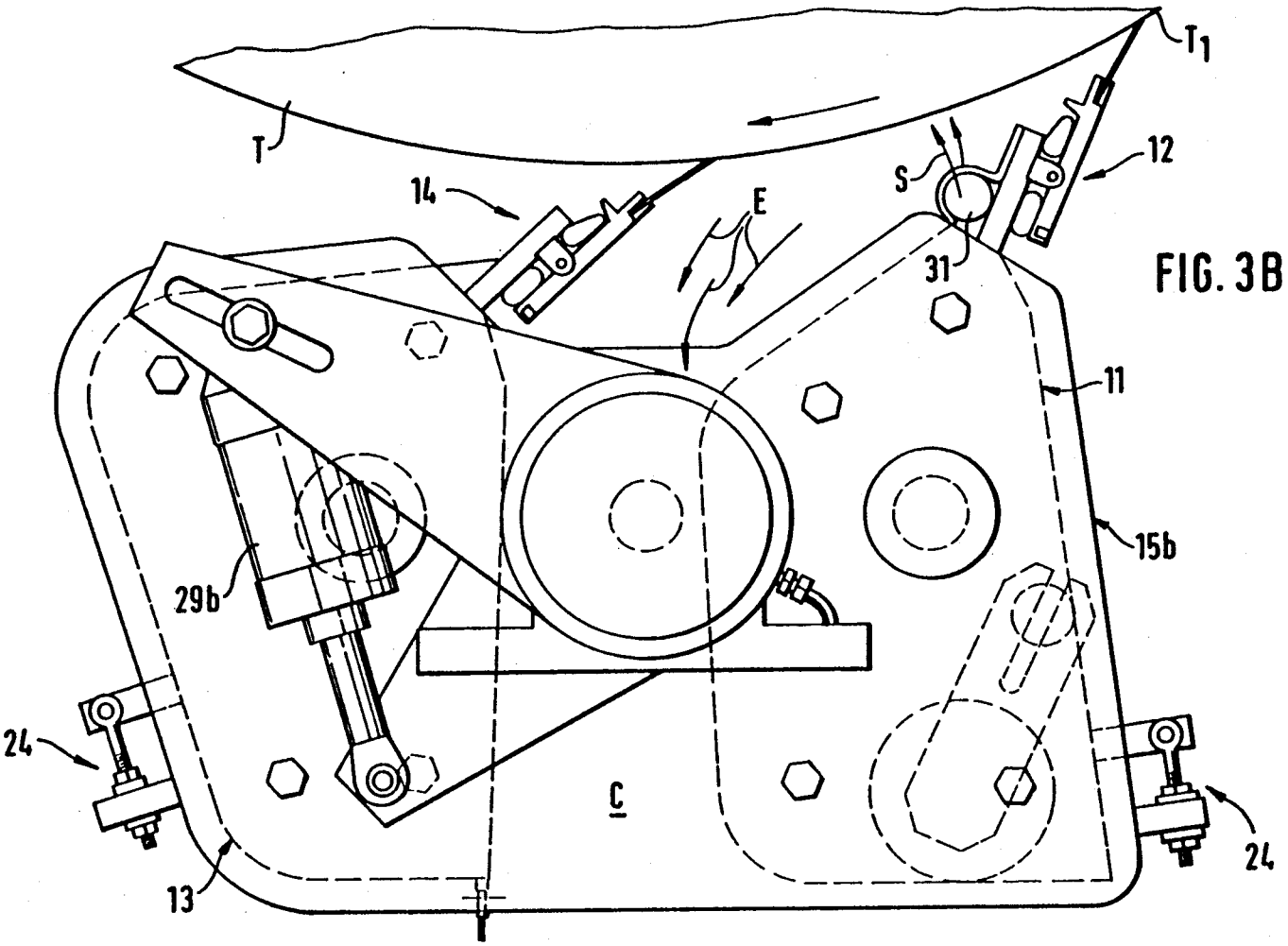
FIG. 3B is an end view of the double doctor construction shown in FIG. 3A.

FIG. 3B is an end view of the construction shown in FIG. 3A. The whole doctor construction has been rotated by means of the cylinder device 29a and 29b to proximity with the roll T, and the fine adjustment of the doctor blades 12 and 14 has been carried out by rotating the doctor beams 11 and 13 related to the doctor blades in relation to the end plates 15a and 15b. The final fine adjustment for determination of the precise front angle of the doctor blade 12 and 14 in relation to the roll face $T_1$ is carried out so that the blade parts 12a and 14a are pivoted by means of the adjusting device 12c and 14c acting upon the frame 12b and 14b of the blade parts 12a and 14a while the frames 12b, 14b pivot on their articulated joints 12d, 14d. As is shown in FIG. 3B, a water jet S is passed from a jet pipe 31 onto the roll face $T_1$ between the blades 12 and 14. As is shown in FIG. 3B, a free space C is formed between the first doctor beam 11 and the second doctor beam 13, through which the scraped material or, for example, in the case of a web break, the paper web itself can be passed freely and directly into the pulper.

Figure 4B:
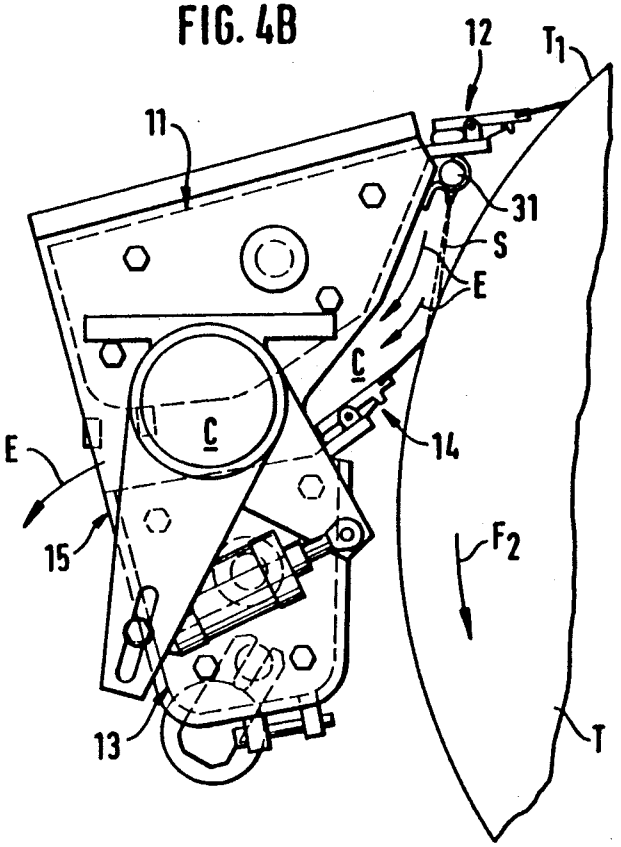
FIG. 4B shows a double doctor in accordance with the invention for a paper machine in connection with an upper roll of a 4-press in the side position.
Figure 4A:
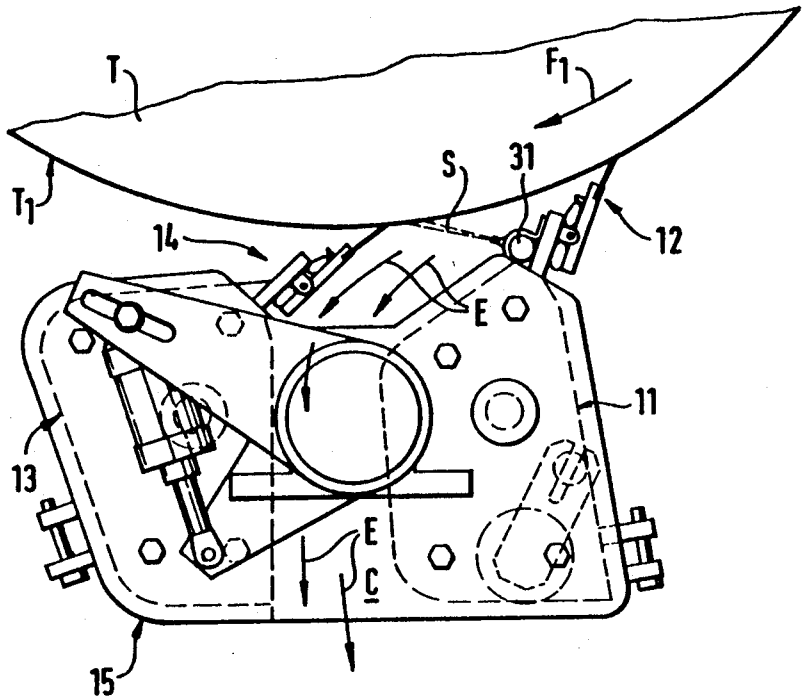
FIG. 4A shows a double doctor in accordance with the invention for a paper machine as placed in a position below the centre roll in the press of the paper machine.

FIG. 4A shows a double doctor in accordance with the invention for a paper machine in a position below the centre roll of the press of a paper machine. The direction of rotation of the roll T is indicated by the arrow $F_1$ in the Figure. The material scraped off the roll face $T_1$ is transferred, in the double doctor construction in accordance with the invention, through the free space C between the first doctor beam 11 and the second doctor beam 13 directly into the pulper in the way indicated by the arrows E.

FIG. 4B shows a double doctor construction in accordance with the invention placed in connection with an upper roll of a 4-press. The direction of rotation of the roll T is indicated by the arrow $F_2$. As is shown by the arrows E, the scraped material is transferred through the free opening C between the first doctor beam 11 and the second doctor beam 13 further away, e.g., into the pulper.

What is claimed is:

1. A double doctor for a paper machine comprising:

a first doctor beam;

a first doctor blade mounted in said first doctor beam;

a second doctor beam;

a second doctor blade mounted in said second doctor beam;

first and second end plates respectively connected to first and second ends of said first and second doctor beams such that an opening exists defined by said first and second doctor beams and said first and second end plates through which opening a paper web or other material scraped off a paper machine roll can be passed directly and without obstruction into a pulper;

means for separately and independently rotating said first and second doctor beams;

wherein said rotating means comprises first and second journals respectively connected between said first end plate and said first doctor beam and between said second end plate and said second doctor beam, and an adjusting device for rotating said first and second doctor beams about their respective central longitudinal axes;

wherein said adjusting device comprises means for engaging one of said end plates and both of said first and second doctor beams;

wherein said engaging means comprises a bracket connected to both doctor beams, a pin connected with one of said end plates, and one or more screws which are connected to said bracket and to said pin such that rotation of one of said screws causes rotation of one of said first and second doctor beams about one of said respective central longitudinal axes; and wherein at least one of said first and second plates has a curved opening in which said screws move for adjustment of one of said first and second doctor beams.

2. A double doctor for a paper machine comprising:

a first doctor beam;

a first doctor blade mounted in said first doctor beam;

a second doctor beam;

a second doctor blade mounted in said second doctor beam;

first and second end plates respectively connected to first and second ends of said first and second doctor beams such that an opening exists defined by said first and second doctor beams and said first and second end plates through which opening a paper web or other material scraped off a paper machine roll can be passed directly and without obstruction into a pulper, each end plate having a shaft and further comprising an actuator means which functions to rotate said first and second doctor beams about a central longitudinal axis of said double doctor.

3. The double doctor blade of claim 2, wherein said actuator means comprises first and second pneumatic cylinders respectively connected to the respective shaft of each end plate.

4. A double doctor for a paper machine comprising:

a first doctor beam;

a first doctor blade mounted in said first doctor beam;

a second doctor beam;

a second doctor blade mounted in said second doctor beam;

first and second end plates respectively connected to first and second ends of said first and second doctor beams such that an opening exists defined by said first and second doctor beams and said first and second end plates through which opening a paper web or other material scraped off a paper machine roll can be passed directly and without obstruction into a pulper, and further comprising one or more jet pipes respectively mounted on at least one of said doctor beams, said one or more jet pipes positioned or arrange so as to spray lubricating liquid such that the surface of the paper machine is lubricated and such that splash liquid is carried directly and without obstruction through said opening.

5. A method for adjustment of the doctor blades in a double-doctor construction in a paper machine, said method comprising the steps of:

attaching said doctor blades to respective doctor beams in said paper machine; and utilizing an adjusting device to rotate at least one of said doctor beams relative to a respective end plate attached thereto;

wherein each of said doctor beams can be rotated independently about its own axis of rotation to position each of said doctor beams for scraping material from a common roll of said paper machine and further comprising rotating one or more of said doctor beams about its axis of rotation by means of a journal having a shaft connected to one of said doctor beams to be rotated, said shaft being fixedly attached to one of said end plates.

6. A method for adjustment of the doctor blades in a double-doctor construction in a paper machine, said method comprising the steps of:

attaching said doctor blades to respective doctor beams in said papermachine; and utilizing an adjusting device to rotate at least one of said doctor beams relative to a respective end plate attached thereto to position each of said doctor beams for scraping material from a common roll of said paper machine, further comprising using an actuator to adjust said doctor blades in said double-doctor construction, the actuator functioning to rotate the entire said double doctor construction on shafts respectively attached to said end plates, said shafts resting on bearings.

* * * * *